US010357965B2

(12) United States Patent
Nishitani et al.

(10) Patent No.: US 10,357,965 B2
(45) Date of Patent: Jul. 23, 2019

(54) PRINTING APPARATUS AND PRINTING METHOD

(71) Applicant: CANON KABUSHIKI KAISHA, Tokyo (JP)

(72) Inventors: Eisuke Nishitani, Tokyo (JP); Masaki Nitta, Yokohama (JP); Yoshiaki Murayama, Tokyo (JP); Keiichirou Takeuchi, Komae (JP); Rinako Kameshima, Tachikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/022,349

(22) Filed: Jun. 28, 2018

(65) Prior Publication Data

US 2019/0009521 A1 Jan. 10, 2019

(30) Foreign Application Priority Data

Jul. 4, 2017 (JP) ..... 2017-131065

(51) Int. Cl.

| | |
|---|---|
| ***B41J 2/01*** | (2006.01) |
| ***B44C 1/165*** | (2006.01) |
| ***B41J 29/17*** | (2006.01) |
| ***B41J 11/00*** | (2006.01) |
| ***B41M 5/025*** | (2006.01) |
| *B41J 25/00* | (2006.01) |

(52) U.S. Cl.

CPC ..... *B41J 2/01* (2013.01); *B41J 11/0015* (2013.01); *B41J 29/17* (2013.01); *B41M 5/025* (2013.01); *B44C 1/165* (2013.01); *B41J 2002/012* (2013.01); *B41J 2025/008* (2013.01)

(58) Field of Classification Search

CPC . B41J 2/01; B41J 11/0015; B41J 29/17; B41J 2002/012; B41J 2025/008; B41M 5/0047; B41M 5/025; B44C 1/165; B01J 20/261; B32B 7/14; B32B 15/082; B32B 37/025; B32B 37/1292; C09D 11/00; C09D 11/02; C09D 11/30; C09D 11/38

See application file for complete search history.

(56) References Cited

U.S. PATENT DOCUMENTS

2011/0141188 A1* 6/2011 Morita ..... B41J 2/0057 347/20
2016/0303870 A1* 10/2016 Moriguchi ..... B41J 2/01

FOREIGN PATENT DOCUMENTS

JP 2009-45851 A 3/2009

* cited by examiner

*Primary Examiner* — Anh T Vo
(74) *Attorney, Agent, or Firm* — Canon U.S.A. Inc., IP Division

(57) ABSTRACT

A printing apparatus having an ink application unit applying a first ink containing at least resin as a solid content onto a discharge medium, a reaction liquid application unit applying a reaction liquid reacting with a component in the ink to aggregate the solid content in the first ink onto the discharge medium, and a liquid absorbing unit for bringing a liquid absorbing member of a porous body into contact with an ink image formed by the ink and the reaction liquid on the discharge medium to absorb liquid to thereby reduce the amount of the liquid in the ink image, in which a layer is formed with the first ink and the reaction liquid on the discharge medium, and then a test pattern utilized for detection is printed by applying a second ink different from the first ink to a part of the layer by the ink application unit.

14 Claims, 11 Drawing Sheets

PRINTING APPARATUS AND PRINTING METHOD

BACKGROUND OF THE INVENTION

Field of the Invention

The present disclosure relates to a printing apparatus and a printing method.

Description of the Related Art

As a printing method using an ink jet system, a method using a reaction liquid aggregating components of an ink containing a coloring material component onto a medium is known. Japanese Patent Laid-Open No. 2009-45851 discloses a method including forming an intermediate image with an ink jet system on a transfer body to which a reaction liquid aggregating a coloring material in an ink is applied, removing a solvent from the intermediate image with a solvent removing portion containing a porous body, and then transferring the intermediate image to a target recording medium.

However, when the application amount of the reaction liquid is insufficient or when the reaction does not sufficiently proceed, it is assumed that the coloring material does not sufficiently aggregate, and then the coloring material enters the inside of the porous body together with the solvent when liquid is removed from an ink image formed by the ink. When the coloring material entering the inside of the porous body closes pores thereinside, it is difficult to remove the entering coloring material and, when the pores remain closed, there is a concern about the liquid removal capability even when the porous body is demanded to be repeatedly utilized. The concern is not limited to the aggregation of the coloring material and is a matter of concern when the image formation with an ink is performed by aggregating a solid content, such as resin, in the ink, with a reaction liquid. However, even when it has been attempted to detect the degree of an aggregation reaction so as to perform printing while avoiding such an insufficient aggregation state, it has been difficult to measure the reaction liquid itself of a printing apparatus to correctly detect the same.

SUMMARY OF THE INVENTION

The present disclosure has been made in view of the above-described disadvantages. It is an aspect of the present disclosure to correctly detect the degree of an aggregation reaction by a reaction liquid.

According to the present disclosure, a printing apparatus has an ink application unit applying a first ink containing at least a resin as a solid content onto a discharge medium, a reaction liquid application unit applying a reaction liquid reacting with a component in the ink to aggregate the solid content in the first ink onto the discharge medium, and a liquid absorbing unit for bringing a liquid absorbing member of a porous body into contact with an ink image formed by the ink and the reaction liquid on the discharge medium to absorb liquid to thereby reduce the amount of the liquid in the ink image, in which the printing apparatus has a receiving unit receiving an instruction for detecting the degree of the reaction of the ink and the reaction liquid on the discharge medium and a control unit controls the ink application unit and the reaction liquid application unit in response to the reception of the instruction by the receiving unit to form a layer on the discharge medium with the first ink and the reaction liquid and causes the ink application unit to apply a second ink different from the first ink to a part of the layer to print a test pattern utilized for the detection.

Further features of the present disclosure will become apparent from the following description of exemplary embodiments with reference to the attached drawings.

DESCRIPTION OF THE EMBODIMENTS

Hereinafter, the present disclosure is described in detail with reference to suitable embodiments.

Hereinafter, an ink jet recording apparatus as an example of a printing apparatus according to an embodiment is described with reference to the drawings.

Examples of the ink jet recording apparatus include an ink jet recording apparatus including discharging an ink onto a transfer body as a discharge medium to form an ink image, and then transferring the ink image after liquid is removed from the ink image by a liquid absorbing member to a recording medium and an ink jet recording apparatus including forming an ink image on a recording medium, such as paper or cloth, as a discharge medium, and then removing liquid by the liquid absorbing member from the ink image on the recording medium. In the present disclosure, the former ink jet recording apparatus is referred to as a transfer type ink jet recording apparatus below for convenience and the latter ink jet recording apparatus is referred to as a direct drawing type ink jet recording apparatus below for convenience.

Hereinafter, each ink jet recording apparatus is described.

Transfer Type Ink Jet Recording Apparatus

Figure 1:
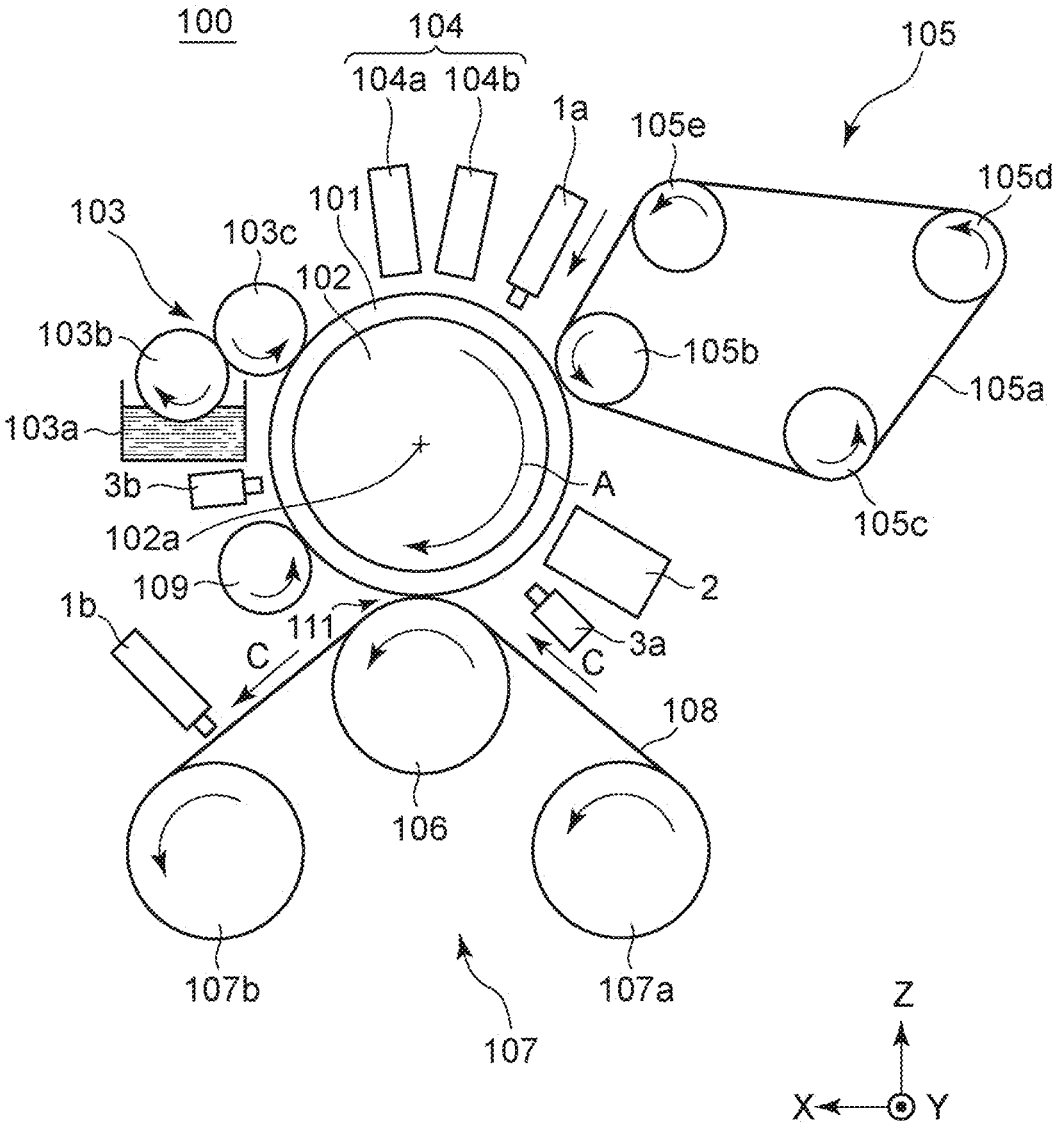
FIG. 1 is a schematic view illustrating an example of the configuration of a transfer type ink jet recording apparatus according to one embodiment of the present disclosure.

FIG. 1 is a schematic view illustrating an example of the schematic configuration of a transfer type ink jet recording apparatus 100 of this embodiment. The recording apparatus is a sheet type ink jet recording apparatus producing recorded matter by transferring an ink image to a recording medium 108 through a transfer body 101. In this embodiment, the X direction, the Y direction, and the Z direction indicate the width direction (total length direction), the depth direction, and the height direction, respectively, of the ink jet recording apparatus 100. A recording medium 108 is conveyed in the X direction but is sometimes conveyed with an inclination from the X direction as indicated by an arrow C in the figure in the middle of the conveyance.

The transfer type ink jet recording apparatus 100 of the present disclosure has a transfer body 101 supported by a support member 102 and a reaction liquid application device 103 applying a reaction liquid reacting with a color ink onto the transfer body 101 as illustrated in FIG. 1. Moreover, an ink application device 104 having an ink jet head applying a colored ink onto the transfer body 101 to which the reaction liquid is applied to form an ink image which is an image with the ink on the transfer body and a liquid absorber 105 removing a liquid component from the ink image on the transfer body are provided. Furthermore, a heating device 2 heating the ink image after the liquid absorption and a pressing member 106 for transfer for transferring the ink image from which a liquid component is removed on the transfer body onto a recording medium 108, such as paper, are provided. Moreover, the transfer type ink jet recording apparatus 100 may have a transfer body cleaning member 109 cleaning the surface of the transfer body 101 after the transfer as necessary. It is a matter of course that the transfer body 101, the reaction liquid application device 103, the ink jet head of the ink application device 104, the liquid absorber 105, and the transfer body cleaning member 109 each have a length corresponding to the recording medium 108 to be used in the Y direction.

The transfer body 101 rotates in the direction as indicated by an arrow A of FIG. 1 around a rotation axis 102*a* of the support member 102. The transfer body 101 moves by the rotation of the support member 102. Onto the moving transfer body 101, a reaction liquid is applied by the reaction liquid application device 103 and an ink is applied by the ink application device 104 in a sequential manner, so that an ink image is formed on the transfer body 101. The ink image formed on the transfer body 101 is moved to a position where the ink image contacts the liquid absorbing member 105*a* provided in the liquid absorber 105 by the movement of the transfer body 101.

The transfer body 101 and the liquid absorber 105 move in synchronization with the rotation of the transfer body 101. The ink image formed on the transfer body 101 passes through a state of contacting the moving liquid absorbing member 105*a*. In the meantime, the liquid absorbing member 105*a* removes a liquid component from the ink image on the transfer body 101. In the contact state, the liquid absorbing member 105*a* can be pressed against the transfer body 101 with predetermined pressing force so as to effectively operate the liquid absorbing member 105*a*.

When described from a different viewpoint, the removal of the liquid component can also be expressed as "concentrating the ink configuring the image formed on the transfer body". The concentration of the ink means that the content ratio of solid contents, such as the coloring material and the resin, contained in the ink to the liquid component increases with a reduction in the liquid component contained in the ink.

The ink image after the liquid absorption from which the liquid component is removed is in a state where the ink is condensed as compared with the ink image before the liquid absorption, and further moved to a transfer portion 111 contacting the recording medium 108, which is conveyed by the recording medium conveying device 107, by the transfer body 101. By the pressing of the transfer body 101 by the pressing member 106 while the ink image after the liquid absorption contacts the recording medium 108, the ink image is transferred onto the recording medium 108. The ink image after the transfer transferred onto the recording medium 108 is a reverse image of the ink image before the liquid absorption and the ink image after the liquid absorption.

In this embodiment, the reaction liquid is applied onto the transfer body, and then the ink is applied, so that an image is formed, and therefore the reaction liquid does not react with the ink and remains in a non-image region where the image with the ink is not formed. With this apparatus, the liquid absorbing member 105*a* removes not only the liquid component from the image but the liquid component of the reaction liquid by contacting the unreacted reaction liquid.

Therefore, in the description above, the expression and the description that the liquid component is removed from the image are not limited to the meaning of removing the liquid component only from the image and mean that the liquid component may be removed at least from the image on the transfer body.

The liquid component is not particularly limited insofar as it does not have a fixed shape, has flowability, and has an almost constant volume.

For example, water, an organic solvent, and the like contained in the ink or the reaction liquid are mentioned as the liquid component.

Each configuration of the transfer type ink jet recording apparatus 100 of this embodiment is described below.

Transfer Body

The transfer body 101 has a surface layer containing an image formation surface. As components of the surface layer, various materials, such as resin and ceramics, can be used as appropriate and materials with a high modulus of compression can be used in terms of durability and the like. Specifically, an acrylic resin, an acrylic silicone resin, a fluorine containing resin, a condensate obtained by condensing a hydrolytic organosilicon compound, and the like are mentioned. In order to increase the wettability, transferability, and the like of the reaction liquid, surface treatment may be performed. Examples of the surface treatment include flame treatment, corona treatment, plasma treatment, polishing treatment, roughing treatment, active energy ray irradiation treatment, ozone treatment, surfactant treatment, silane coupling treatment, and the like. The treatment may be used in combination of two or more kinds thereof. An arbitrary surface shape can also be provided to the surface layer.

The transfer body can have a compression layer having a function of absorbing pressure fluctuations. By providing the compression layer, the compression layer can absorb deformation and disperse the fluctuation of a local pressure fluctuation, and thus good transferability can be maintained also in high speed printing. Examples of components of the compression layer include acrylonitrile-butadiene rubber, acrylic rubber, chloroprene rubber, urethane rubber, silicone rubber, and the like, for example. Those which are made porous by compounding a predetermined amount of a vulcanizing agent, a vulcanization accelerator, and the like, and further compounding a foaming agent and a filler, such as hollow particles or a common salt, as necessary in the molding of rubber materials can be used. Thus, bubble portions are compressed with volume changes to various pressure fluctuations, and therefore the deformation in directions other than the compression direction is small, and thus more stable transferability and durability can be obtained. As porous rubber materials, those having a continuation pore structure in which the pores are connected to each other and those having an independent pore structure in which the pores are independent from each other are mentioned. In the present disclosure, both the structures may be acceptable and the structures may be used in combination.

The transfer body can further have an elastic layer between the surface layer and the compression layer. As components of the elastic layer, various materials, such as resin and ceramics, can be used as appropriate. In terms of the processing characteristics and the like, various elastomer materials and rubber materials can be used. Specific examples include, for example, fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene, nitrile butadiene rubber, and the like. In particular, the silicone rubber, the fluorosilicone rubber, and the phenylsilicone rubber have low small compression set, and thus are suitable in terms of dimensional stability and durability. Moreover, the rubber has a low elastic modulus change due to temperatures and is suitable also in terms of transferability.

Between the layers (surface layer, elastic layer, compression layer) configuring the transfer body, various adhesives or a double-sided tape may be used in order to fix and hold the layers. Moreover, a reinforcing layer with a high modulus of compression may be provided in order to suppress transverse elongation when attached to the apparatus or maintain stiffness. Woven fabrics may be used as the reinforcing layer. The transfer body can be produced by arbitrarily combining the layers containing the materials mentioned above.

The size of the transfer body can be freely selected according to the size of a target image to be printed. The shape of the transfer body is not particularly limited and a sheet shape, a roller shape, a belt shape, an endless web shape, and the like are specifically mentioned.

Support Member

The transfer body 101 is supported on the support member 102. As a method for supporting the transfer body 101, various adhesives or a double-sided tape may be used. Or, an installation member containing metals, ceramics, resin, and the like as a material may be attached to the transfer body 101 so that the transfer body 101 may be supported on the support member 102 using the installation member.

The support member 102 is required to have a certain degree of structural strength from the viewpoint of the conveyance accuracy or durability thereof. For the materials of the support member 102, metals, ceramics, resin, and the like can be used. Among the above, in order to improve not only the rigidity to withstand the pressurization in transfer or the dimensional accuracy but the responsiveness of the control by reducing the inertia in the operation, aluminum, iron, stainless steel, acetal resin, epoxy resin, polyimide, polyethylene, polyethylene terephthalate, nylon, polyurethane, silica ceramics, and alumina ceramics can be used. The materials can also be used in combination.

Reaction Liquid Application Device

The ink jet recording apparatus 100 of this embodiment has the reaction liquid application device 103 applying a reaction liquid to the transfer body 101. FIG. 1 illustrates a case where the reaction liquid application device 103 is a gravure offset roller having a reaction liquid storage portion 103*a* storing a reaction liquid and reaction liquid application members 103*b* and 103*c* applying the reaction liquid in the reaction liquid storage portion 103*a* onto the transfer body 101.

The reaction liquid application device 103 may be any device insofar as a reaction liquid can be applied onto a discharge medium and various devices known heretofore can be used as appropriate. Specifically, a gravure offset roller, an ink jet head, a die coating device (die coater), a blade coating device (blade coater), and the like are mentioned. The application of the reaction liquid by the reaction liquid application device 103 may be performed before the application of an ink or may be performed after the application of an ink insofar as the reaction liquid can be mixed (reacted) with the ink on a discharge medium. The reaction liquid is suitably applied before the application of an ink. By applying the reaction liquid before the application of an ink, bleeding in which inks applied to be adjacent to each other are mixed or beading in which an ink landing before is attracted to an ink landing later in image recording by an ink jet system can also be prevented.

Reaction Liquid

The reaction liquid contains a component increasing the viscosity of an ink (ink viscosity increasing component). The increase in the ink viscosity also includes a case where a coloring material, resin, or the like forming a part of the composition configuring the ink contacts the ink viscosity increasing component to be chemically reacted or physically adsorbed thereto, and thus an increase in the viscosity of the entire ink is recognized or a case where a viscosity increase locally occurs by the aggregation of a part of components configuring the ink, such as a coloring material. The ink viscosity increasing component has an effect of reducing the flowability of the ink and/or a part of the ink composition on a discharge medium to suppress the bleeding or the beading in the image formation with the ink. As such an ink viscosity increasing component, known substances, such as polyvalent metal ions, organic acids, cationic polymers, and porous fine particles, are usable. Among the above, the polyvalent metal ions and the organic acids are particularly usable. A plurality of kinds of ink viscosity increasing components can also be compounded. The content of the ink viscosity increasing component in the reaction liquid is preferably 5% by mass or more based on the total mass of the reaction liquid.

Examples of the polyvalent metal ions include divalent metal ions, such as $Ca^{2+}$, $Cu^{2+}$, $Ni^{2+}$, $Mg^{2+}$, $Sr^{2+}$, $Ba^{2+}$, and $Zn^{2+}$, and trivalent metal ions, such as $Fe^{3+}$, $Cr^{3+}$, $Y^{3+}$, $Al^{3+}$, for example.

Examples of the organic acids include, for example, oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyronecarboxylic acid, pyrrolecarboxylic acid, furancarboxylic acid, pyridinecarboxylic acid, coumaric acid, thiophenecarboxylic acid, nicotinic acid, oxysuccinic acid, dioxysuccinic acid, and the like.

The reaction liquid can contain an appropriate amount of water and organic solvents having low volatility. The water to be used in this case can be water deionized by ion exchange or the like. The organic solvents usable for the reaction liquid are not particularly limited and known organic solvents are usable.

The reaction liquid can be used after the surface tension and the viscosity are adjusted as appropriate by adding a surfactant or a viscosity modifier. Materials to be used are not particularly limited insofar as the materials can coexist with the ink viscosity increasing component. Specific examples of the surfactant to be used include an acetylene glycol ethylene oxide adduct ("Acetylenol E100", Trade Name, manufactured by Kawaken Fine Chemicals Co., Ltd.), a perfluoroalkyl ethylene oxide adduct ("Megafac F444", Trade Name, manufactured by DIC Corporation), and the like.

Ink Application Device

The ink jet recording apparatus 100 of this embodiment has the ink application device 104 applying an ink to the transfer body 101. In FIG. 1, a reaction liquid and an ink are mixed, so that an ink image is formed by the reaction liquid and the ink on the transfer body 101, and further a liquid component is removed from the ink image by the liquid absorber 105.

In this embodiment, an ink jet head is used as the ink application device 104 applying an ink. FIG. 1 illustrates an ink jet 104*a* for a first color and an ink jet head 104*b* for a second color different from the first color and ink jet heads for the other colors can be disposed side by side in the X direction to be utilized. As the ink jet head, a mode of causing film boiling in an ink by electrothermal converter to form bubbles to thereby discharge the ink, a mode of discharging an ink by an electromechanical converter, a mode of discharging an ink utilizing static electricity, and the like are mentioned, for example. In this embodiment, known ink jet heads are usable. In particular, from the viewpoint of high density printing at a high speed, one utilizing an electrothermal converter can be used. In the drawing, a required amount of an ink is applied to each position by receiving an image signal.

In this embodiment, the ink jet heads form a full line head disposed so as to extend in the Y direction and nozzles are arranged in a range covering a portion corresponding to the width of an image recording region of a recording medium of the maximum usable size. Each ink jet head has an ink discharge surface in which the nozzle is opened in the undersurface (transfer body 101 side). The ink discharge surface faces the surface of the transfer body 101 with a minute gap (about several millimeters).

The ink application amount can be expressed by the image density (duty) or the ink thickness but, in this embodiment, the average value obtained by multiplying the mass of each ink dot by the number of applied dots, and then dividing the obtained number by the printing area is defined as the ink application amount ($g/m^2$). The maximum ink application amount in the image region indicates the ink application amount applied in an area of at least 5 $mm^2$ or more in a region used as information on a discharge medium from the viewpoint of removing the liquid component in the ink.

The ink application device 104 may have a plurality of ink jet heads in order to apply color inks of various colors onto a discharge medium. For example, when color images are formed using a yellow ink, a magenta ink, a cyan ink, and a black ink, the ink application device has four ink jet heads discharging the four kinds of inks mentioned above onto a discharge medium and the ink jet heads are disposed side by side in the X direction.

The ink application device may contain an ink jet head discharging a clear ink which contains no coloring materials or which contains the coloring materials in a very low proportion, even if contained, and thus is substantially transparent. The clear ink can be utilized in order to form an ink image together with the reaction liquid and the color inks. For example, the clear ink is usable in order to increase the glossiness of an image. A resin component to be compounded may be adjusted as appropriate and further the discharge position of the clear ink may be controlled so that an image after transfer brings about a glossy feeling. It is desirable that the clear ink is located on the top layer side than the color inks in final recorded matter, and therefore the clear ink is applied onto the transfer body 101 before the color inks in the transfer type recording apparatus. Therefore, in the movement direction of the transfer body 101 facing the ink application device 104, the ink jet head for the clear ink can be disposed on the upstream side relative to the ink jet heads for the color inks.

The clear ink can be utilized not only in order to improve the glossiness but in order to improve the transferability of an image from the transfer body 101 to a recording medium. For example, a large amount of a component revealing adhesiveness is compounded in the clear ink as compared with the color inks, and then the clear ink is applied to the color inks, whereby the clear ink can be utilized as a transferability improvement liquid to be applied onto the transfer body 101. For example, in the movement direction of the transfer body 101 facing the ink application device 104, an ink jet head for the clear ink for improving the transferability is disposed on the downstream side relative to the ink jet heads for the color inks. Then, the color inks are applied to the transfer body 101, and then the clear ink is applied onto the transfer body after the color inks are applied, whereby the clear ink is present on the outermost surface of an ink image. In the transfer of the ink image to the recording medium 108 in the transfer portion 111, the clear ink on the surface of the ink image adheres to the recording medium 108 with a certain degree of adhesive force, and thus the movement of the ink image after liquid absorption to the recording medium 108 is facilitated.

Ink

Each component of the ink to be applied to this embodiment is described.

Coloring Material

As the coloring materials to be contained in the ink to be applied to this embodiment, pigments or a mixture of dyes and pigments are usable. The kinds of the pigments usable as the coloring material are not particularly limited. As specific examples of the pigments, inorganic pigments, such as carbon black; and organic pigments, such as azo-based pigments, phthalocyanine-based pigments, quinacridone-based pigments, isoindolinone-based pigments, imidazolone-based pigments, diketopyrrolopyrrole-based pigments, and dioxazine-based pigments, can be mentioned. One or two or more of the pigments can be used as necessary.

The kinds of the dyes usable as the coloring material are not particularly limited. As specific examples of the dyes, direct dyes, acidic dyes, basic dyes, disperse dyes, food colors, and the like can be mentioned, and dyes having anionic groups are usable. Specific examples of dye skeletons include an azo skeleton, a triphenylmethane skeleton, a phthalocyanine skeleton, an azaphthalocyanine skeleton, a xanthene skeleton, an anthrapyridone skeleton, and the like.

The content of the pigment in the ink is preferably 0.5% by mass or more and 15.0% by mass or less and more preferably 1.0% by mass or more and 10.0% by mass or less based on the total mass of the ink.

Dispersant

As a dispersant dispersing the pigment, known dispersants for use in an ink jet ink are usable. In particular, a water-soluble dispersant having both a hydrophilic portion and a hydrophobic portion in the structure can be used in an aspect of this embodiment. In particular, a pigment dispersant containing at least a resin obtained by copolymerizing hydrophilic monomers and hydrophobic monomers can be used. The monomers used herein are not particularly limited and known substances can be used. Specifically, styrene and other styrene derivatives, alkyl(meth)acrylates, benzyl (meth)acrylate, and the like are mentioned as the hydrophobic monomers. Acrylic acids, methacrylic acids, maleic acids, and the like are mentioned as the hydrophilic monomers.

The acid value of the dispersant is preferably 50 mgKOH/g or more and 550 mgKOH/g or less. The weight average molecular weight of the dispersant is preferably 1000 or more and 50000 or less. The mass ratio (pigment: dispersant) of the pigment and the dispersant is preferably in the range of 1:0.1 to 1:3.

A so-called self-dispersible pigment obtained by surface-modifying a pigment itself to make the pigment dispersible can be used in this embodiment, without using the dispersant.

Resin Particles

The ink to be applied to this embodiment can be used by compounding various fine particles having no coloring materials. In particular, resin fine particles can be used because the resin fine particles are effective in an improvement of image quality or fixability in some cases.

Materials of the resin fine particles usable in this embodiment are not particularly limited and known resin can be used as appropriate. Specific examples include homopolymers, such as polyolefin, polystyrene, polyurethane, polyester, polyether, polyurea, polyamide, polyvinyl alcohol, poly(meth)acrylic acid and a salt thereof, poly(meth)alkyl acrylate, and polydiene, or copolymers obtained by polymerizing a plurality of monomers for generating the homopolymers in combination. The weight average molecular weight (Mw) of the resin is preferably in the range of 1,000 or more and 2,000,000 or less. The amount of the resin fine particles in the ink is preferably 1% by mass or more and 50% by mass or less and more preferably 2% by mass or more and 40% by mass or less based on the total mass of the ink.

In an aspect of this embodiment, the resin fine particles can be used as a resin fine particle dispersion in which the resin fine particles are dispersed in liquid. A dispersion technique is not particularly limited and a so-called self-dispersible resin fine particle dispersion which is dispersed using resin obtained by homopolymerizing monomers having dissociable groups or copolymerizing a plurality of kinds of the monomers can be used. Herein, examples of the dissociable groups include a carboxyl group, a sulfonic acid group, a phosphate group, and the like. Examples of the monomers having the dissociable groups include acrylic acid, methacrylic acid, and the like. Moreover, a so-called emulsified dispersion type resin fine particle dispersion obtained by dispersing the resin fine particles with emulsifiers can be similarly used in this embodiment. The emulsifiers as used herein can be known surfactants irrespective of a low molecular weight and a high molecular weight. The surfactants can be nonionic surfactants or surfactants having the same charges as those of the resin fine particles.

The resin fine particle dispersion for use in an aspect of this embodiment preferably has a dispersion diameter of 10 nm or more and 1000 nm or less and more preferably has a dispersion diameter of 100 nm or more and 500 nm or less.

When producing the resin fine particle dispersion for use in an aspect of this embodiment, various additives can also be added for stabilization. Examples of the additives include n-hexadecane, dodecyl methacrylate, stearyl methacrylate, chlorobenzene, dodecyl mercaptan, blue dyes (bluing agents), polymethyl methacrylate, and the like, for example.

Surfactant

An ink usable for this embodiment may also contain surfactants. Specific examples of the surfactant include an acetylene glycol ethylene oxide adduct (Acetylenol E100, manufactured by Kawaken Fine Chemicals Co., Ltd.) and the like. The amount of the surfactant in the ink is preferably 0.01% by mass or more and 5.0% by mass or less based on the total mass of the ink.

Water and Water-Soluble Organic Solvent

The ink for use in this embodiment can contain water and/or a water-soluble organic solvent as a solvent. The water can be water deionized by ionic exchange or the like. The content of the water in the ink is preferably 30% by mass or more and 97% by mass or less based on the total mass of the ink.

The kind of the water-soluble organic solvent to be used is not particularly limited and any known organic solvent can be used. Specific examples include glycerol, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, methanol, and the like. It is a matter of course that two or more kinds of substances selected from the substances mentioned above can also be used as a mixture.

The content of the water-soluble organic solvent in the ink is preferably 3% by mass or more and 70% by mass or less based on the total mass of the ink.

Other Additives

The ink usable for this embodiment may contain various additives, such as a pH adjuster, an antirust, an antiseptic, an antifungal agent, an antioxidant, a reduction inhibitor, a water-soluble resin and a neutralizer therefor, and a viscosity modifier, as necessary besides the components mentioned above.

Liquid Absorber

In this embodiment, the liquid absorber 105 has a liquid absorbing member 105*a* and a pressing member 105*b* for liquid absorption pressing the liquid absorbing member 105*a* against an ink image on the transfer body 101. The shapes of the liquid absorbing member 105*a* and the pressing member 105*b* are not particularly limited. For example, a configuration may be acceptable in which the pressing member 105*b* has a columnar shape and the liquid absorbing member 105*a* has a belt shape, and the belt-shaped liquid absorbing member 105*a* is pressed against the transfer body 101 with the columnar pressing member 105*b* as illustrated in FIG. 1. Alternatively, a configuration may be acceptable in which the pressing member 105*b* has a columnar shape and the liquid absorbing member 105*a* has a cylindrical shape formed on the peripheral surface, and the cylindrical liquid absorbing member 105*a* is pressed against the transfer body 101 with the columnar pressing member 105*b*.

In this embodiment, the liquid absorbing member 105*a* can have a belt shape when space within the ink jet recording apparatus 100 and the like are taken into consideration.

The liquid absorber 105 having the liquid absorbing member 105*a* of such a belt shape may have a stretching member stretching the liquid absorbing member 105*a*. In FIG. 1, 105*c* denotes a stretching roller as the stretching member. In FIG. 1, the pressing member 105*b* is also a roller member rotating in the same manner as the stretching roller but is not limited thereto.

The liquid absorber 105 presses the liquid absorbing member 105*a* having a porous body against an ink image by the pressing member 105*b* to contact the same to thereby cause the liquid absorbing member 105*a* to remove a liquid component contained in the ink image to reduce the liquid component.

As a method for reducing the liquid component in the ink image, not only the above-described mode of bringing the liquid absorbing member 105*a* into contact with the ink image but various techniques used heretofore, e.g., a method by heating, a method of sending low humidity air, a decompressing method, and the like, may be used. Moreover, in addition to the above-described mode of bringing the liquid absorbing member 105*a* into contact with the ink image, the methods mentioned above may be applied to the ink image after the liquid absorption in which the liquid component is reduced to further reduce the liquid component.

Liquid Absorbing Member

In this embodiment, at least one part of the liquid component is removed from the ink image before the liquid absorption by bringing the same into contact with the liquid absorbing member 105*a* having a porous body to thereby reduce the content of the liquid component in the ink image. The contact surface with the ink image of the liquid absorbing member 105*a* is defined as a first surface, and a porous body is disposed on the first surface. The liquid absorbing member 105*a* having such a porous body can have a shape capable of absorbing liquid while circulating which moves interlocking with the movement of a discharge medium to contact the ink image, and then re-contacts the ink image before liquid absorption at a predetermined cycle. For example, shapes, such as an endless belt shape and a drum shape, are mentioned.

Porous Body

In the porous body of the liquid absorbing member 105*a* according to this embodiment, one in which the average pore size on the first surface side is smaller than the average pore size on the side of a second surface facing the first surface can be used. In order to prevent the coloring material in the ink from adhering to the porous body, the pore size can be made small and the average pore size of the porous body at least on the first surface side contacting an image is preferably 10 μm or less. In this embodiment, the average pore size indicates the average diameter on the first surface or the second surface and can be measured by known methods, e.g., a mercury penetration method, a nitrogen adsorption method, SEM image observation, and the like.

In order to achieve uniformly high air permeability, the thickness of the porous body can be reduced. The air permeability can be indicated by a Gurley value specified in JIS P8117 and the Gurley value is preferably 10 seconds or less.

However, when the thickness of the porous body is reduced, the capacity required for absorbing the liquid component cannot be sufficiently secured in some cases, and therefore the porous body can be formed into a multilayer configuration. In the liquid absorbing member 105*a*, a layer contacting the ink image may be a porous body and a layer not contacting the ink image may not be a porous body.

Thus, the ink image from which the liquid component is removed and the liquid component is reduced is formed on the transfer body 101. The ink image after the liquid absorption is next transferred onto the recording medium 108 in the transfer portion 111. The apparatus configuration and the conditions in the transfer are described.

Pressing Member for Transfer

In this embodiment, the ink image after the liquid absorption on the transfer body 101 is transferred onto the recording medium 108 conveyed by the recording medium conveyance unit 107 by bringing the ink image into contact with the recording medium 108 by the pressing member 106 for transfer. After removing the liquid component contained in the ink image on the transfer body 101, the ink image is transferred onto the recording medium 108, whereby a record image with reduced curling, cockling, or the like can be obtained.

The pressing member 106 is demanded to have a certain degree of structural strength from the viewpoint of the conveyance accuracy or durability of the recording medium 108. For materials of the pressing member 106, metals, ceramics, resin, and the like can be used. Among the above, in order to improve not only the rigidity to withstand the pressurization in transfer or the dimensional accuracy but the responsiveness of the control by reducing the inertia in the operation, aluminum, iron, stainless steel, acetal resin, epoxy resin, polyimide, polyethylene, polyethylene terephthalate, nylon, polyurethane, silica ceramics, and alumina ceramics can be used. The materials may be used in combination.

The pressing time when the pressing member 106 presses the transfer body 101 in order to transfer the ink image after the liquid absorption on the transfer body 101 to the recording medium 108 is not particularly limited and is preferably 5 ms or more and 100 ms or less so as to perform good transfer and so as not to impair the durability of the transfer body 101. The pressing time in this embodiment indicates the time when the recording medium 108 and the transfer body 101 are in contact with each other and a value is calculated by performing surface pressure measurement using a surface pressure distribution meter ("I-SCAN", manufactured by Nitta, Corp.), and then dividing the conveyance direction length in a pressurized region by the conveyance speed.

The pressure pressing the transfer body 101 by the pressing member 106 in order to transfer the ink image after the liquid absorption on the transfer body 101 to the recording medium 108 is also not particularly limited and is set so as to perform good transfer and so as not to impair the durability of the transfer body 101. Therefore, the pressure is preferably 9.8 $N/cm^2$ (1 $kg/cm^2$) or more and 294.2 $N/cm^2$ (30 $kg/cm^2$) or less. The pressure in this embodiment indicates the nip pressure between the recording medium 108 and the transfer body 101 and a value is calculated by performing surface pressure measurement using a surface pressure distribution meter, and then dividing the load in a pressurized region by the area.

The temperature when the pressing member 106 presses the transfer body 101 in order to transfer the ink image after the liquid absorption on the transfer body 101 to the recording medium 108 is also not particularly limited and can be equal to or higher than the glass transition point or the softening point of the resin component contained in the ink. An aspect of having a heating unit heating a second image on the transfer body 101, the transfer body 101, and the recording medium 108 is suitable for heating.

The shape of the transfer device 106 is not particularly limited and one having a roller-shape is mentioned, for example.

Recording Medium and Recording Medium Conveying Device

In this embodiment, the recording medium 108 is not particularly limited and any known recording medium can be used. Examples of the recording medium include a long substance wound in a roll shape or a sheet-like substance cut into a predetermined size. Examples of materials include paper, a plastic film, a wooden board, corrugated paper, a metal film, and the like.

In FIG. 1, the recording medium conveying device 107 for conveying the recording medium 108 is configured by a recording medium feeding roller 107*a* and a recording medium winding roller 107*b* but may be able to convey a recording medium and thus is not particularly limited to the configuration.

Determination of Reaction Degree by Reaction Liquid

In this embodiment, a test pattern created by applying an ink a, and then applying an ink b different from the ink a onto the ink a is created, and then it is determined whether an aggregation reaction by a reaction liquid sufficiently proceeds. The determination may be automatically performed using a reading device mounted in an ink jet recording apparatus or an external reading device or may be performed by visually observing a test pattern, and then inputting information on the determined result into an ink jet recording apparatus by a user. The following example describes an example of creating a pattern on the transfer body 101.

Figure 8A:
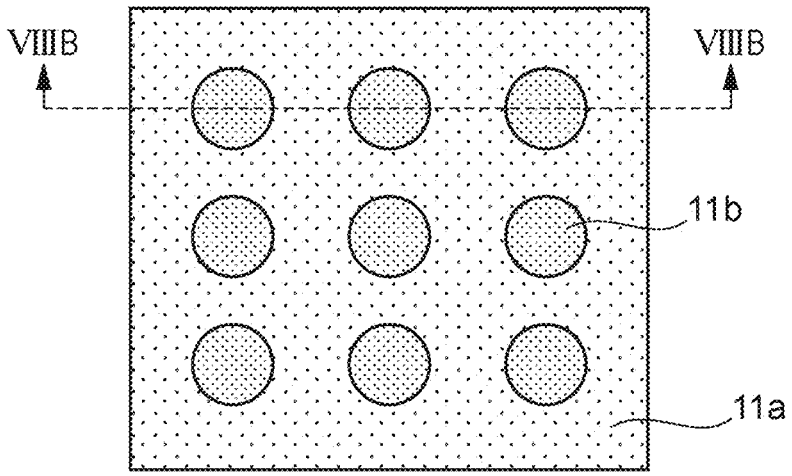
FIGS. 8A and 8B are schematic views illustrating an example of a test pattern according to one embodiment of the present disclosure.
Figure 8B:
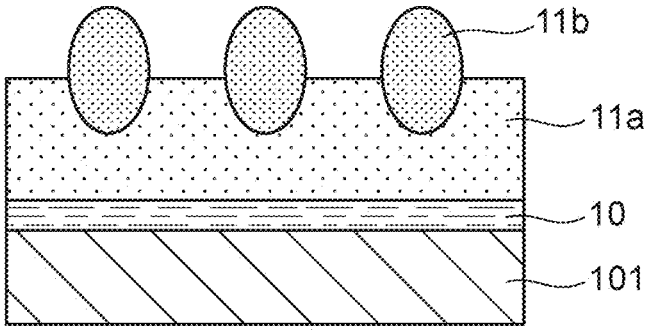
Figure 9A:
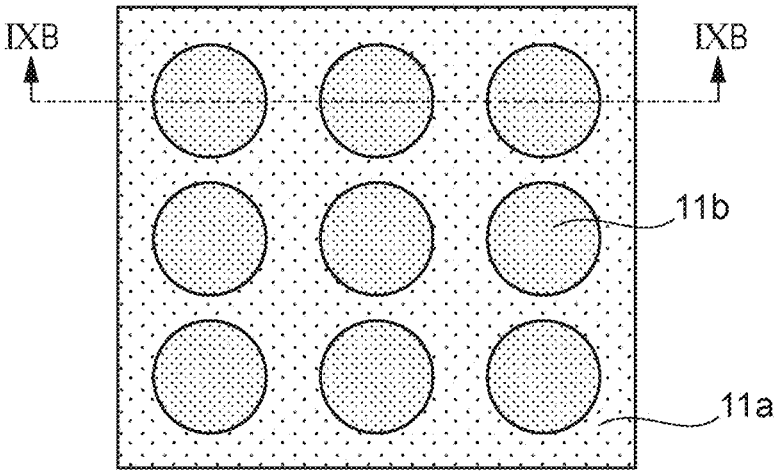
FIGS. 9A and 9B are schematic views illustrating an example of a test pattern according to one embodiment of the present disclosure.
Figure 9B:
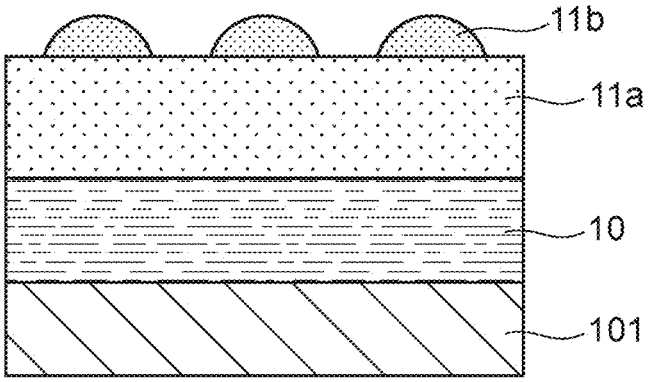

An example of the test pattern is illustrated in FIGS. 8A and 8B and FIGS. 9A and 9B. As the test pattern, an image is used in which the reaction liquid 10 is applied to the transfer body 101 by the reaction liquid application device 103, a predetermined amount (herein 20 g/m$^2$) of the ink 11*a* reacting with the reaction liquid 10 is applied, and then single dots of an ink 11*b* of a color different from the color of the ink 11*a* are applied to a plurality of places at equal intervals. The interval of the dots of the ink 11*b* is about several μm. A difference in the test patterns between FIGS. 8A and 8B and FIGS. 9A and 9B is the application amount of the reaction liquid 10 and the other conditions on the printing of the test patterns are the same. FIGS. 8A and 8B are schematic views illustrating the state of the reaction liquid 10 and the inks 11*a* and 11*b* on the transfer body 101 when the amount of the reaction liquid 10 is insufficient. FIGS. 9A and 9B are schematic views illustrating the state of the reaction liquid 10 and the inks 11*a* and 11*b* on the transfer body 101 when the amount of the reaction liquid 10 is larger than that of FIGS. 8A and 8B and is appropriate. In this embodiment, it is determined based on the size of the dots of the ink 11*b* in the two cases whether the reaction by the reaction liquid 10 sufficiently proceeds.

FIG. 8A is a schematic view when the surface of the transfer body 101 is viewed from above. FIG. 8B is a schematic cross sectional view illustrating the state of the cross section when the transfer body 101 is cut vertically to the surface of the transfer body 101 at the position along the VIIIB-VIIIB line of FIG. 8A. As illustrated in FIG. 8B, the application amount of the reaction liquid 10 is small, and therefore the ink 11*a* does not sufficiently react, so that the degree of the aggregation of a solid content of the ink 11*a* is low. Therefore, when the ink 11*b* is applied onto the ink 11*a*, the ink 11*b* enters a layer of the ink 11*a*, and thus the diameter of dots of the ink 11*b* is small as compared with the case of FIGS. 9A and 9B described later. The reaction of the ink 11*a* in this case is insufficient. When the reaction degree in printing is this degree, the solid contents in the ink 11*a* and 11*b* tend to move to the liquid absorbing member 105*a* by the liquid absorption from an ink image by the liquid absorbing member 105*a*, and thus the solid contents are difficult to remove by cleaning of the liquid absorbing member 105*a* in some cases. As a factor for the reduction in the application amount of the reaction liquid 10, the application conditions are mentioned.

FIG. 9A is a schematic view when the surface of the transfer body 101 is viewed from above. FIG. 9B is a schematic cross sectional view illustrating the state of the cross section when the transfer body 101 is cut vertically to the surface of the transfer body 101 at the position along the IXB-IXB line of FIG. 9A. As illustrated in FIG. 9B, when the application amount of the reaction liquid 10 is appropriate, the ink 11*a* sufficiently reacts, and thus a layer of the ink 11*a* is sufficiently solidified. Therefore, when the ink 11*b* is applied, dots of the ink 11*b* do not sink into the layer of the ink 11*a*, and then formed on the layer of the ink 11*a*, so that the dots of the ink lib sufficiently spread. The dot diameter is larger than that in the case of FIG. 8B. When reacted to this degree, even when the liquid absorbing member 105*a* is brought into contact with the inks 11*a* and 11*b* under pressure in printing, a solid content of the ink 11*a* is hard to move to the liquid absorbing member 105*a*, and thus liquid absorption by the liquid absorbing member 105*a* can be normally performed.

Subsequently, a determination method using the test patterns is described. The areas of the inks 11*b* are different from each other between the state illustrated in FIGS. 8A and 8B and the state illustrated in FIGS. 9A and 9B, and therefore the pattern is measured with a sensor to obtain the information on the area of the dots of the ink lib on the layer of the ink 11*a*, whereby it can be determined whether the ink 11*a* is sufficiently aggregated by the reaction liquid 10. As the sensor, when the pattern on the transfer body 101 is read immediately after the pattern formation, a sensor 1*a* provided immediately downstream of the ink application device 104 in the rotation direction of the transfer body 101 as illustrated in FIG. 1 can be utilized. When the pattern after transferred to paper is read with a sensor, a sensor 1*b* similarly illustrated in FIG. 1 can be utilized. The area of the dots of the ink 11*b* applied to the upper side in the test patterns is reflected on the density and the color, and therefore the determination can also be performed by comparing the density or the color optically detected using the sensors 1*a* and 1*b* with a predetermined threshold value. In this case, the printer control portion 303 receives detection signals of the test patterns from the sensors 1*a* and 1*b*, and then the determination may be performed by comparing the detection signals with a predetermined threshold value in a CPU 401, for example.

The pattern in the state illustrated in FIGS. 9A and 9B may be prepared as a standard reference pattern, and then the determination may be performed by visually comparing a printed pattern with a reference pattern by a user.

The above-described pattern is the pattern formed so that single dots of the ink 11*b* are scattered on the ink 11*a* but may be a pattern in which one or two or more large dots, in which two or more of the dots of the ink 11*b* are overlapped, are formed or may be a ruled line pattern.

Herein, when an ink having brightness lower than that of the ink 11*a*, i.e., a dark color ink, can be used for the ink 11*b* because the dots of the ink 11*b* are easily detected in comparison with the surrounding ink 11*a*.

In this embodiment, the application amount of the ink 11*a* is set to 20 g/m$^2$ but the application amount is not particularly limited.

When ink jet heads for 3 or more colors are arranged in the X direction in the ink application device 104, the ink 11*a* and the ink 11*b* can be individually applied by the two ink jet heads adjacent to each other in the X direction. Thus, the time until the ink 11*b* is applied after applying the ink 11*a* is shorter than that in a case of not using a combination of the adjacent ink jet heads, and therefore the effects of the reaction liquid 10 can be evaluated under severe conditions. Even when the nozzle arrays for 3 or more colors are arranged in the X direction, the same effects can be obtained by using the adjacent nozzle arrays.

The difference in the application amount of the reaction liquid 10 appears as a difference in reactivity in the test patterns of FIGS. 8A and 8B and FIGS. 9A and 9B described above. However, even when the application amount is the same, the degree of progress of the reaction varies when the temperature in the reaction varies, for example. Even in such a case, a test pattern is formed in such a manner that the ink lib is buried into the ink 11*a* as illustrated in FIGS. 8A and 8B, and the degree of the reaction can be reflected in the form where a user or the apparatus can recognize the same.

Control System

Figure 3:
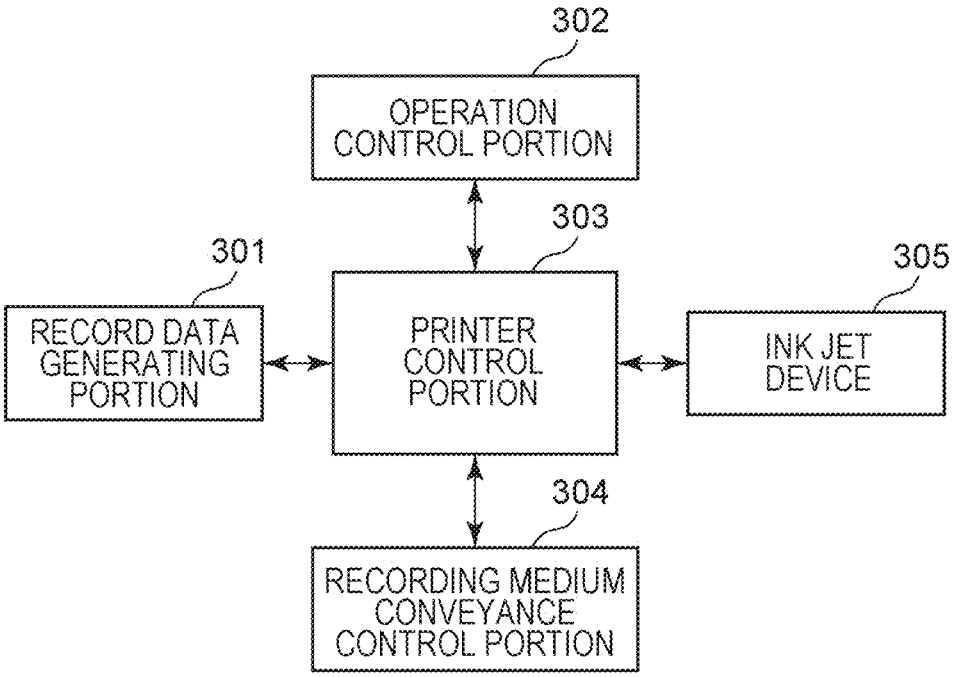
FIG. 3 is a block diagram illustrating a control system of the entire apparatus in the ink jet recording apparatus illustrated in each of FIGS. 1 and 2.

The transfer type ink jet recording apparatus 100 in this embodiment has a control system controlling each device. FIG. 3 is a block diagram illustrating a control system of the entire apparatus in the transfer type ink jet recording apparatus 100 illustrated in FIG. 1.

FIG. 3 includes a record data generating portion 301, such as an external print server, an operation control portion 302, such as an operation panel, a printer control portion 303 for performing a recording process, a recording medium conveyance control portion 304 for conveying a recording medium, and an ink jet device 305 for performing printing and corresponds to the ink application device 104 of FIG. 1.

Figure 4:
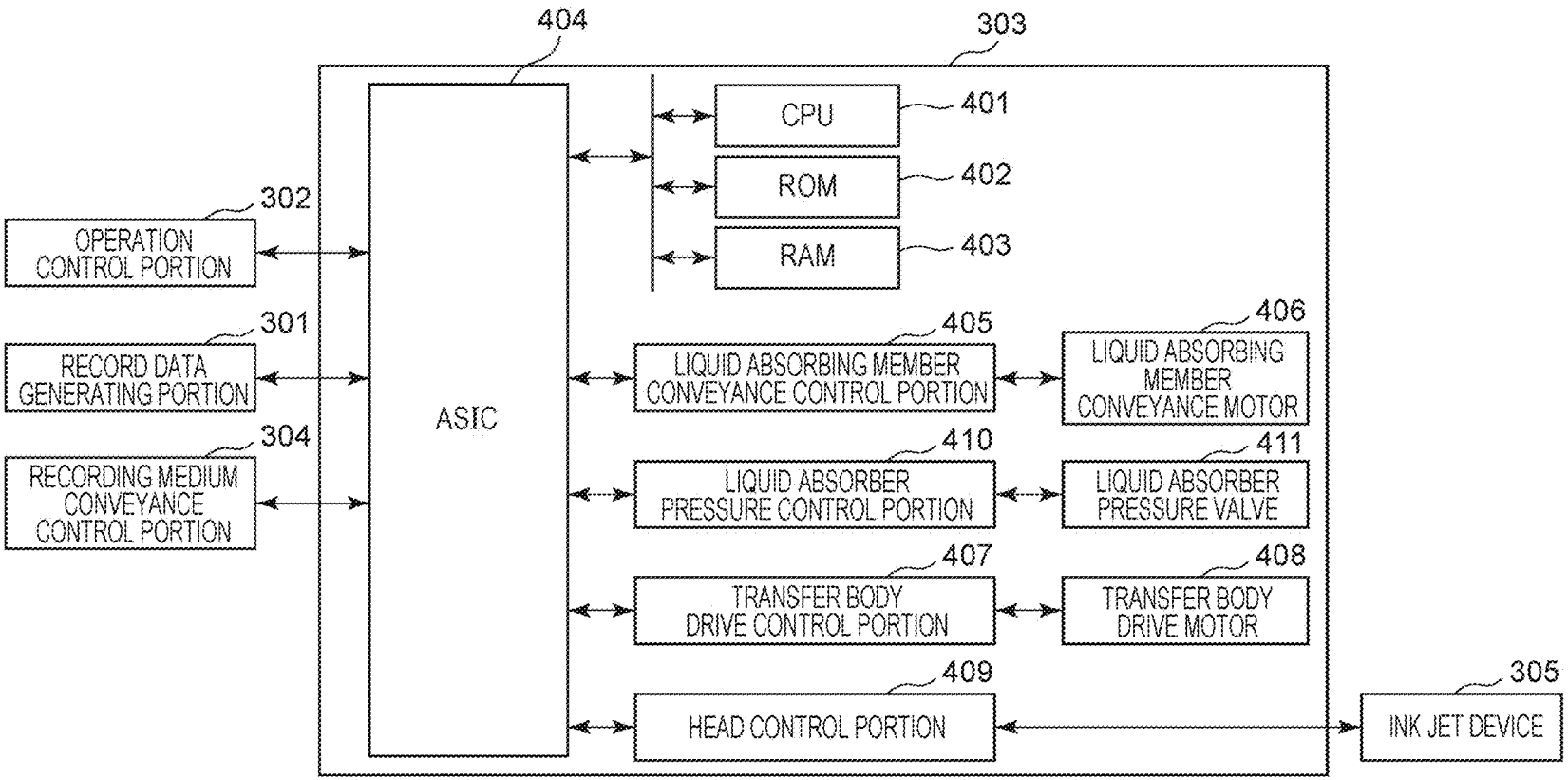
FIG. 4 is a block diagram of a printer control portion in the transfer type ink jet recording apparatus illustrated in FIG. 1.

FIG. 4 is a block diagram of the printer control portion 303 in the transfer type ink jet recording apparatus 100 of FIG. 1.

401 denotes the CPU controlling the entire printer, 402 denotes a ROM for storing a control program of the CPU 401, and 403 denotes a RAM for executing a program. 404 denotes an integrated circuit for specific application (Application Specific Integrated Circuit: ASIC) in which a network controller, a serial IF controller, a controller for generating head data, a motor controller, and the like are built. 405 denotes a liquid absorbing member conveyance control portion for driving a liquid absorbing member conveyance motor 406 and is command-controlled through the serial IF from ASIC 404. 407 is a transfer body drive control portion for driving a transfer body drive motor 408 and is similarly command-controlled through the serial IF from the ASIC 404. 409 denotes a head control portion and performs final discharge data generation, drive voltage generation, and the like of the ink jet device 305.

In this embodiment, in order to prevent a solid content in an insufficiently aggregated ink from moving to the liquid absorbing member 105*a* when a test pattern is created, a function is provided which moves the transfer body 101 and the liquid absorber 105 relatively to each other to separate the transfer body 101 and the liquid absorber 105 from each other. 410 denotes a liquid absorber pressure control portion for controlling a liquid absorber pressure valve 411 and is command-controlled through the serial IF from the ASIC 404. Using a liquid absorber pressure control portion 410, the liquid absorber 105 is separated from the transfer body 101 in a determination mode of the reaction liquid application amount and the liquid absorber 105 is caused to abut on the transfer body 101 in a usual printing mode. The details are described later.

Figure 7:
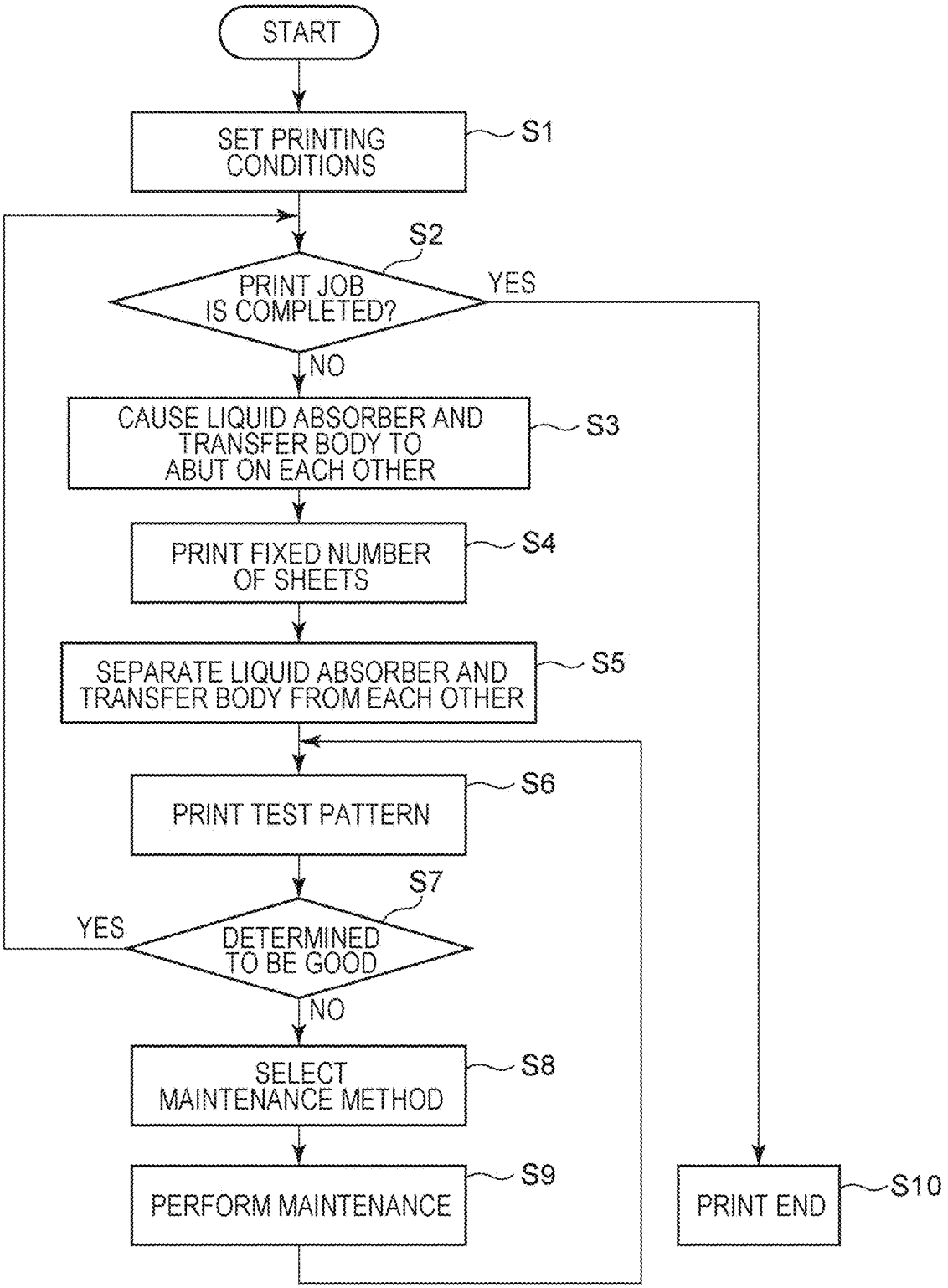
FIG. 7 is a sequence diagram for maintaining a high definition image by maintaining an appropriate reaction liquid application amount in Example 2.

Next, the operation procedure in the ink jet recording apparatus 100 of this embodiment is described in detail using FIG. 1 and FIG. 7.

FIG. 7 is a flow chart illustrating the flow of the printing operation of the ink jet recording apparatus 100 in this embodiment. When the apparatus 100 is started to start printing, the ASIC 404 first receives information on the print settings (total number of sheets to be printed, print sheet type, print image, test pattern, fixed number of sheets) input by a user through the operation control portion 302 in printing condition setting of Step S1. The CPU 401 moves the information to the RAM 402 from the ASIC 404, and then stores the same therein. The current number of sheets to be printed is recorded in the RAM 402. The CPU 401 counts up the current number of sheets to be printed when the number of sheets to be printed increases by one sheet.

Subsequently, in Step S2, the CPU 401 compares the current number of sheets to be printed and the total number of sheets to be printed stored in the RAM 402, and then, when the current number of sheets to be printed is larger, the process proceeds to Step S10 to end the printing.

When the current number of sheets to be printed is smaller, the process proceeds to Step S3. In Step S3, the CPU 401 gives instruction to the ASIC 404, controls the liquid absorber pressure valve 411 through the liquid absorber pressure control portion 410, moves the liquid absorber 105, and then brings the liquid absorbing member 105*a* into contact with the transfer body 101. In the subsequent Step S4, according to the information stored in the ROM 402, an instruction is given from the CPU 401 so as to print a print image by only a fixed number of sheets. When the remaining required number of sheets to be printed is less than the fixed number of sheets, the printing ends when the printing of the required number of sheets is completed. Step S3 and S4 are in usual printing modes. In the usual printing mode, the liquid absorbing member 105*a* and the transfer body 101 contact each other as illustrated in FIG. 1, and thus liquid absorption is in an effective state. When the printing of the fixed number of sheets is completed in Step S4, the process proceeds to a mode of determining the effects of a reaction liquid.

Figure 10:
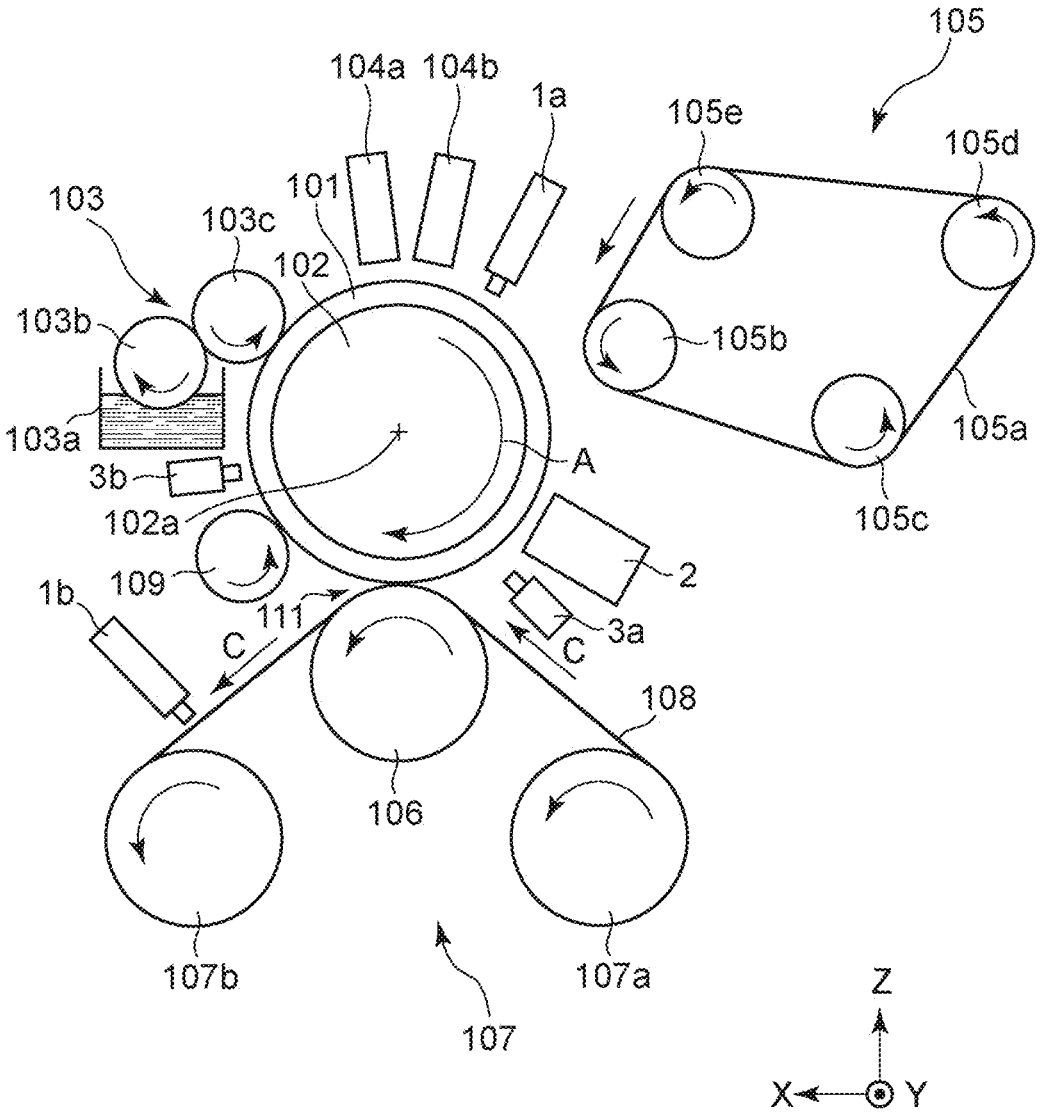
FIG. 10 is a view illustrating a state where a transfer body and a liquid absorber are separated from each other in the transfer type ink jet recording apparatus.

Step S6 and Step S7 are in determination modes of the effects of the reaction liquid. Then, Step S8 and Step S9 are in maintenance modes accompanying the determination modes. First, in Step S5, the CPU 401 gives an instruction to the ASIC 404, the liquid absorber pressure valve 411 is controlled through the liquid absorber pressure control portion 410, and then the liquid absorber 105 is separated from the transfer body 101 to bring the state into the state of FIG. 10. Thus, when the reaction is insufficient in the determination mode of the effects of the reaction liquid, a solid content of an insufficiently aggregated ink can be prevented from moving to the liquid absorber 105 to enter the inside of the porous body of the liquid absorbing member 105*a*.

In the following Step S6, by an execution instruction by the CPU 401, the ASIC 404 receiving the instruction causes the ink jet device 305 to print a test pattern stored in the ROM 402 using the head control portion 409.

Subsequently, in Step S7, the test pattern is read with the sensor 1*b* illustrated in FIG. 1, and then the determination is performed based on the read image data. The test pattern on the transfer body 101 can be read with the sensor 1*a*, and then determined with the printer control portion 303. The density and the like of the read results are notified to a user through the operation control portion 302, and then the process proceeds to the maintenance described later by an instruction from the user or the process may proceed to the maintenance by receiving an input from a user visually observing the printed test pattern.

For the sensors 1*a* and 1*b*, line type sensors, such as CCD and CIS, are usable. The color may be measured with a colorimetric sensor.

In Step S7, when the determination result is good, i.e., it is determined that the reaction is sufficient, the process proceeds to Step S2 of printing a fixed number of sheets again, and then it is determined whether the printing is completed. On the other hand, in Step S7, when it is determined that the application amount of the reaction liquid is not sufficient, a user is informed of the necessity of the maintenance, and then the process proceeds to Step S8 of selecting the maintenance method. Herein, the user performs an input about the device of the ink jet recording apparatus 100 to be subjected to the maintenance through the operation control portion 302 in order to improve the reactivity, e.g., returning the application amount of the reaction liquid to a sufficient amount and the like, and then the process enters the maintenance mode described later.

Subsequently, the process proceeds to Step S9 of performing the maintenance. In Step S9, the maintenance of various devices is performed, and then, after performing the maintenance, an instruction for the process to proceed to Step S6 is input through the operation control portion 302. The maintenance can be automatically performed by the ink jet recording apparatus 100 but may be manual maintenance by a user. Then, in Step S6, a test pattern is printed again, and then it is determined again whether the determination result is "O.K." in Step S7.

By performing the determination of the application amount of the reaction liquid for every predetermined number of sheets according to the sequence, the adhesion of the solid content in the ink to the liquid absorber 105 can be prevented, and thus the liquid absorption characteristics of the liquid absorber 105 can be maintained. The maintaining of the efficacy of removing excessive moisture in the ink leads to the prevention of blurring on a recording medium or the prevention of curling of a medium.

In addition to performing the steps from S3 to S9 for every printing of a predetermined number of sheets, the steps may be performed after the printing is temporarily stopped and the apparatus is stopped, and then the printing is started again. At this time, the CPU 401 of the printer control portion 303 may determine the execution, but a user may input an execution instruction through the operation control portion 302.

Maintenance of Device

Subsequently, the maintenance about the reaction liquid 10 in the ink jet recording apparatus 100 is described. As illustrated in FIGS. 8A and 8B, when the application amount of the reaction liquid 10 is small, the maintenance of various devices is performed in order to increase the application amount of the reaction liquid 10. The maintenance can deal with not only the case where the amount of the reaction liquid 10 is small but a case where, even when the application amount of the reaction liquid 10 is sufficient, the reactivity is low due to other factors in some cases, and the cases are described later.

Next, the maintenance device performed in this embodiment is described in detail.

Maintenance of Reaction Liquid Application Device

In the reaction liquid application device 103, the application amount of the reaction liquid 10 decreases due to a trouble of the reaction liquid application member 103*b* in some cases. Or, the application amount of the reaction liquid 10 decreases due to insufficient pressure between the reaction liquid application member 103*c* and the transfer bodies 101 in some cases. In such a case, the maintenance, such as cleaning of the reaction liquid application device 103*b*, or the adjustment for increasing the pressure between the reaction liquid application member 103*c* and the transfer body 101 is performed.

Maintenance of Heating Device

The activity in the reaction is insufficient due to the temperature of the transfer body 101, so that the reaction does not sufficiently proceed in some cases.

In such a case, the operation of the heating device 2 is confirmed. Specifically, an observation confirmation by visual observation by a user or a confirmation by temperature measurement is mentioned. The confirmation method by temperature measurement is described in detail. When referred to FIG. 1, the temperature of the transfer body 101 is measured with a noncontact thermometer 3*a*, and then it is confirmed whether the heating by the heating device 2 is normally performed. Furthermore, the temperature immediately before the reaction liquid application device 103 can be measured with a noncontact thermometer 3*b*, and then it can be confirmed whether the temperature immediately before the reaction liquid application is normal. When the temperature of the noncontact thermometer 3*a* or 3*b* has abnormalities, the maintenance of the heating device 2 is performed. When an infrared heating system is used for the heating device 2, the exchange or cleaning of a lamp, cleaning of a reflection mirror, or the like may be performed.

Maintenance of Transfer Body

A change of the adhesion amount of the reaction liquid 10 may be caused by a change of the surface state of the transfer body 101 due to continuous use. In such a case, the surface state of the transfer body 101 is confirmed, and then the transfer body 101 is exchanged as necessary. On the other hand, when dirt adheres to the transfer body 101, the operation of a transfer body cleaning device is confirmed, and then the maintenance by the transfer body cleaning member 109 is performed as necessary.

FIG. 1 illustrates a system in which the reaction liquid application device 103 performs application with a roller but a system of performing application with an ink jet head may be acceptable. When the system of performing the application with an ink jet head is used, the system is suitable in a respect that the application amount of the reaction liquid can be controlled on demand. For example, a plurality of test patterns different in the application amount of the reaction liquid 10 are printed at once, the test pattern of an appropriate application amount of the reaction liquid 10 is selected therefrom, and then the application amount of the reaction liquid 10 in usual printing can be changed to the application amount of the reaction liquid 10 when the selected pattern is formed.

Direct Drawing Type Ink Jet Recording Apparatus

As another embodiment in this embodiment, a direct drawing type ink jet recording apparatus is mentioned. In the direct drawing type ink jet recording apparatus, a discharge medium is a recording medium on which an image is to be formed.

Figure 2:
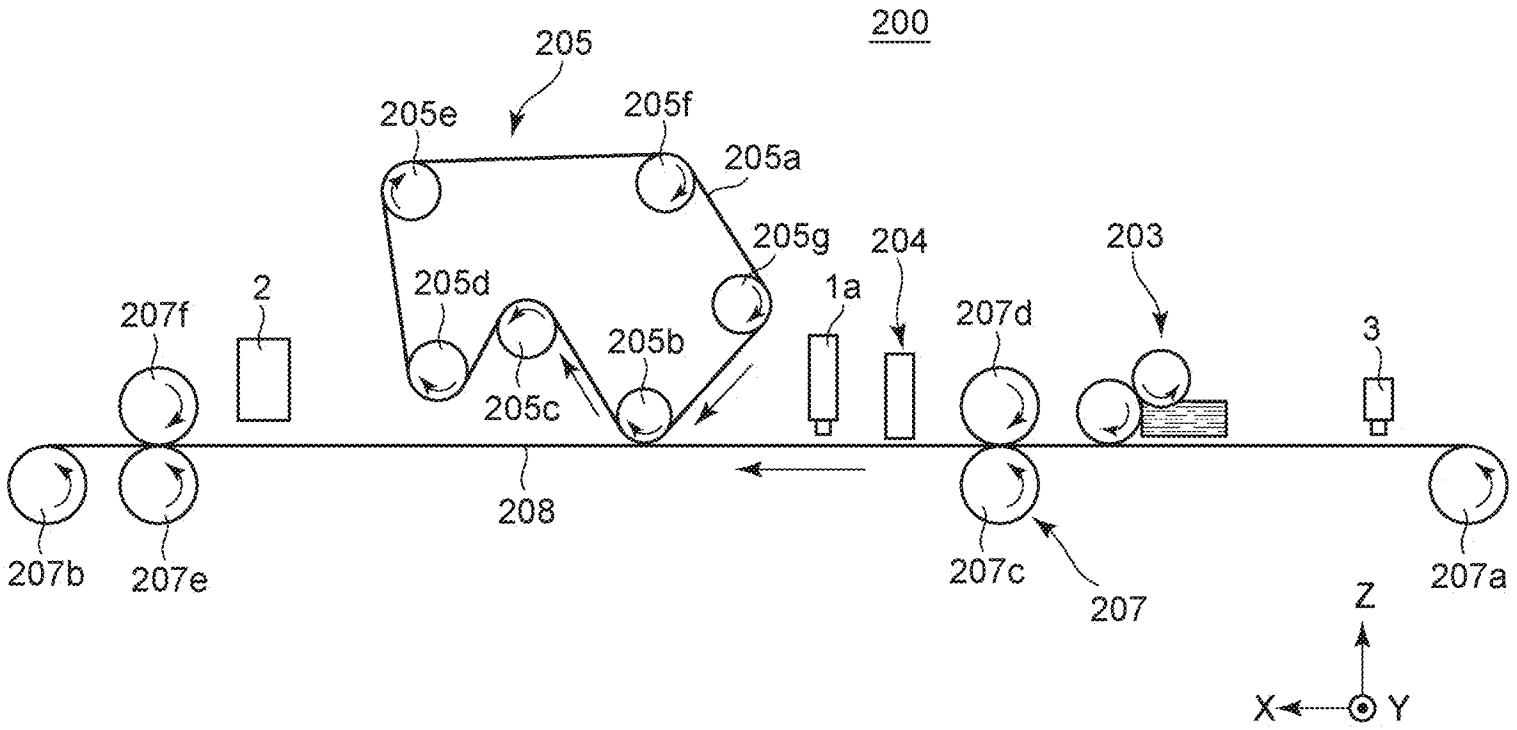
FIG. 2 is a schematic view illustrating an example of the configuration of a direct drawing type ink jet recording apparatus according to one embodiment of the present disclosure.

FIG. 2 is a schematic view illustrating an example of the schematic configuration of a direct drawing type ink jet recording apparatus 200 in this embodiment. As compared with the transfer type ink jet recording apparatus 100 described above, the direct drawing type ink jet recording apparatus 200 has the same units as those of the transfer type ink jet recording apparatus 100, except not having the transfer body 101, the support member 102, and the transfer body cleaning member 109 and forming an image on a recording medium 208.

Therefore, a liquid absorber 205 removing a liquid component contained in the ink image by a reaction liquid application device 203 applying a reaction liquid to the recording medium 208, an ink application device 204 applying an ink to the recording medium 208, and an liquid absorbing member 205*a* contacting an ink image on the recording medium 208 has the same configuration as that of the transfer type ink jet recording apparatus 100, and thus a description thereof is omitted.

In the direct drawing type ink jet recording apparatus 200 of this embodiment, the liquid absorber 205 has a liquid absorbing member 205*a* and a pressing member 205*b* for liquid absorption pressing the liquid absorbing member 205*a* against an ink image on the recording medium 208. The shapes of the liquid absorbing member 205*a* and the pressing member 205*b* are not particularly limited and those having the same shapes as the shapes of a liquid absorbing member and a pressing member usable in a transfer type ink jet recording apparatus are usable. The liquid absorber 205 may have a stretching member stretching the liquid absorbing member 205*a*. In FIG. 2, 205*c*, 205*d*, 205*e*, 205*f*, and 205*g* denote stretching rollers as the stretching member. The number of the stretching rollers is not limited to five of FIG. 4, and a required number of the stretching rollers may be disposed according to the design of the apparatus. Moreover, an ink application portion applying an ink to the recording medium 208 by the ink application device 204 and a liquid component removal portion bringing the liquid absorbing member 205*a* into contact with an ink image on the recording medium 208 to remove a liquid component may be provided with a recording medium support member (not illustrated) supporting the recording medium 208 from below.

Recording Medium Conveying Device

In the direct drawing type ink jet recording apparatus 200 of this embodiment, a recording medium conveying device 207 is not particularly limited and a conveyance unit in a known direct drawing type ink jet recording apparatus is usable. As an example, a recording medium conveying device having a recording medium feeding roller 207*a*, a recording medium winding roller 207*b*, and recording medium conveyance rollers 207*c*, 207*d*, 207*e*, and 207*f* as illustrated in FIG. 2 is mentioned.

Control System

The direct drawing type ink jet recording apparatus 200 in this embodiment has a control system controlling each device. A block diagram illustrating a control system of the entire apparatus in the direct drawing type ink jet recording apparatus 200 illustrated in FIG. 2 is as illustrated in FIG. 3 as with the transfer type ink jet recording apparatus 100 illustrated in FIG. 1.

Figure 5:
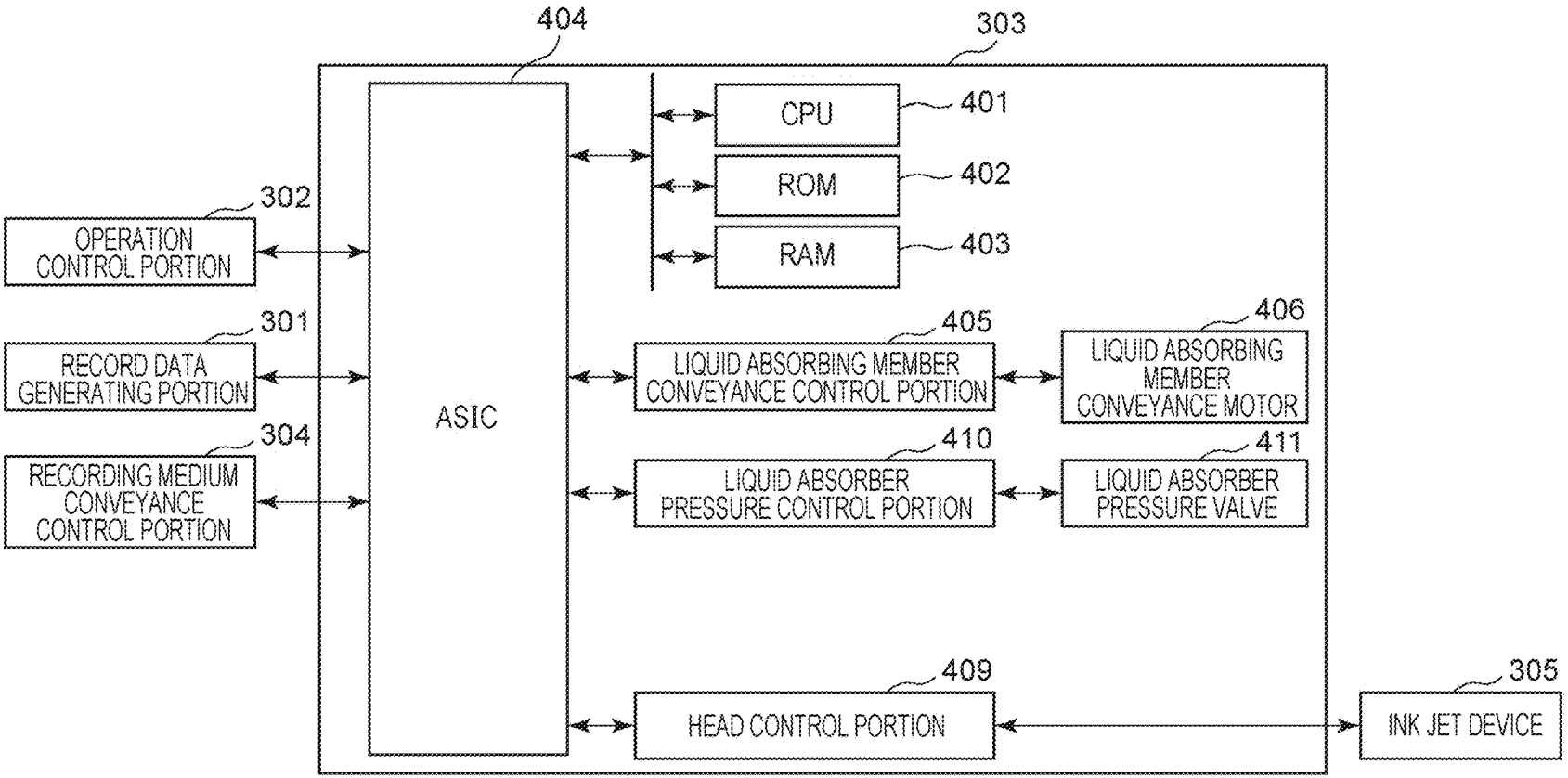
FIG. 5 is a block diagram of a printer control portion in the direct drawing type ink jet recording apparatus illustrated in FIG. 2.

FIG. 5 is a block diagram of a printer control portion in the direct drawing type ink jet recording apparatus 200 of FIG. 2. The block diagram is equivalent to the block diagram of the printer control portion 303 in the transfer type ink jet recording apparatus 100 in FIG. 4, except not having the transfer body drive control portion 407 and the transfer body drive motor 408.

In the case of the direct drawing type ink jet recording apparatus 200, the liquid absorber pressure control portion 410 has a function of separating the liquid absorber 105 from the recording medium 208. The ink jet device 305 corresponds to the ink application device 204.

Figure 11:
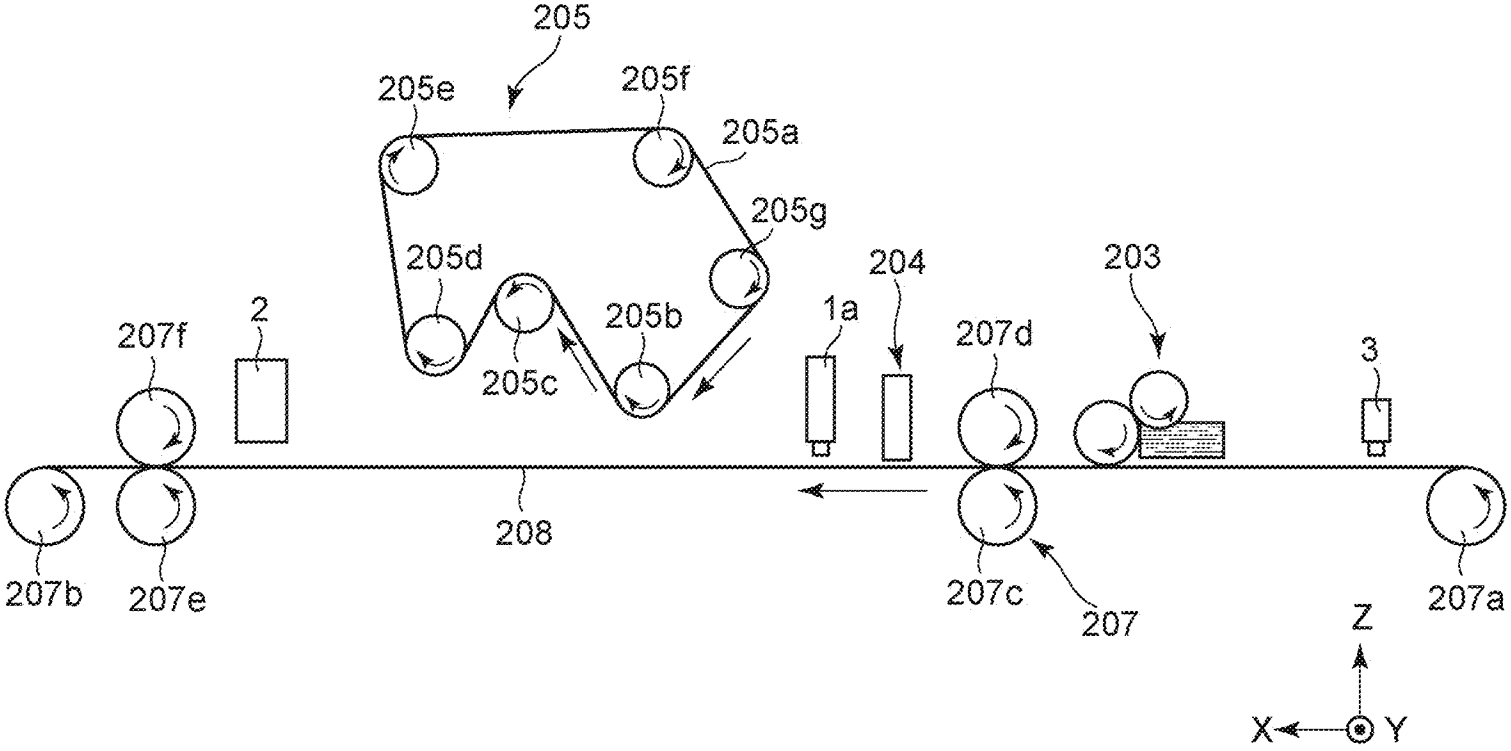
FIG. 11 is a view illustrating a state where a recording medium and a liquid absorber are separated from each other in the direct drawing type ink jet recording apparatus.

Also in the direct drawing type ink jet recording apparatus 200, printing, the determination of the application amount of a reaction liquid, and maintenance can be performed according to the sequence illustrated in FIG. 7. However, the direct drawing type ink jet recording apparatus 200 is different from the transfer type ink jet recording apparatus 100 in that Step S3 is in a stage of causing the liquid absorber 205 and the recording medium 208 to abut on each other and Step S5 is in a stage of separating the liquid absorber 205 and the recording medium 208. FIG. 11 is a schematic view when the liquid absorber 205 is separated from the recording medium 208 in determining the reaction liquid application amount.

EXAMPLES

Hereinafter, the embodiments are described in more detail with reference to Examples. The present disclosure is not limited at all by the following examples without deviating from the gist. In the description of the following examples, "part(s)" are on a mass basis unless otherwise particularly specified.

A test pattern of the application amount of a reaction liquid was printed as follows using the apparatus 100 of FIG. 1.

First, as a reaction liquid applied by the reaction liquid application unit 103, one having the following composition was used.

| | |
|---|---|
| Glutaric acid | 21.0 parts |
| Glycerol | 5.0 parts |
| Surfactant (Product Name: Megafac F444, manufactured by DIC Corporation) | 5.0 parts |
| Ion exchanged water | Balance |

An ink was prepared as follows.

Preparation of Pigment Dispersion

Preparation of Black Pigment Dispersion Liquid 10 parts of carbon black (Product Name: Monarch 1100, manufactured by Cabot Corporation), 15 parts of a resin aqueous solution (obtained by neutralizing an aqueous solution of a styrene-ethyl acrylate-acrylic acid copolymer having an acid value of 150, a weight average molecular weight (Mw) of 8,000, and a resin content of 20.0% by mass with a potassium hydroxide aqueous solution), and 75 parts of pure water were mixed, and then charged into a batch type vertical sand mill (manufactured by AIMEX CO., Ltd.). Then, 200 parts of zirconia beads having a diameter of 0.3 mm was charged thereinto, and then the mixture was dispersed for 5 hours under water cooling. The dispersion liquid was centrifuged to remove coarse particles, and then a black pigment dispersion having a pigment content of 10.0% by mass was obtained.

Preparation of Cyan Pigment Dispersion Liquid

A cyan pigment dispersion liquid was prepared in the same manner as the preparation of the black pigment dispersion liquid, except replacing the 10 parts of carbon black used in the preparation of the black pigment dispersion liquid with 10% C.I. Pigment Blue 15:3.

Preparation of Resin Particle Dispersion 20 parts of ethyl methacrylate, 3 parts of 2,2'-azobis-(2-methylbutyronitrile), and 2 parts of n-hexadecane were mixed, and then stirred for 0.5 hour. The mixture was added dropwise to 75 parts of a 8% aqueous solution of a styrene-butyl acrylate-acrylic acid copolymer (Acid value: 130 mgKOH/g, Weight average molecular weight (Mw): 7,000), and then stirred for 0.5 hour. Next, ultrasonic waves were emitted with an ultrasonic irradiation machine for 3 hours. Subsequently, a polymerization reaction was performed at 80° C. for 4 hours under a nitrogen atmosphere, and then filtered after reducing the temperature to room temperature to prepare a resin particle dispersion having a resin content of 25.0% by mass.

Preparation of Ink

The resin particle dispersion and the pigment dispersion obtained above were mixed with following components. The balance of the ion exchanged water is the amount set so that the total of all the components configuring an ink is 100.0% by mass.

| | |
|---|---|
| Pigment dispersion (The content of a coloring material is 10.0% by mass.) | 40.0% by mass |
| Resin particle dispersion | 20.0% by mass |
| Glycerol | 7.0% by mass |
| Polyethylene glycol (Number average molecular weight (Mn): 1,000) | 3.0% by mass |
| Surfactant: Acetylenol E100 (manufactured by Kawaken Fine Chemicals Co., Ltd.) | 0.5% by mass |
| Ion exchanged water | Balance |

The substances were sufficiently stirred, and then filtered under pressure with a microfilter (manufactured by Fuji Photo Film Co., Ltd.) having a pore size of 3.0 μm to prepare a black ink and a cyan ink.

For the ink application unit 104, an ink jet head of a type of discharging an ink by an on-demand system using an electrothermal conversion element was used.

The recording medium 108 is conveyed by the recording medium feeding roller 107*a* and the recording medium winding roller 107*b* in such a manner as to have the same speed as the movement speed of the transfer body 101. In this example, the conveyance speed was set to 0.5 m/s and an aurora coated paper (manufactured by Nippon Paper Industries Co., Ltd., Basis weight of 128 g/m$^2$) was used as the recording medium 108.

Figure 6A:
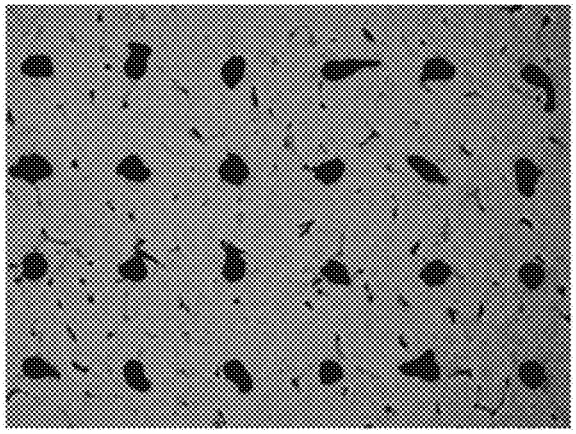
FIGS. 6A to 6C are images of determination patterns when the application amount of a reaction liquid is varied in Example 1.
Figure 6B:
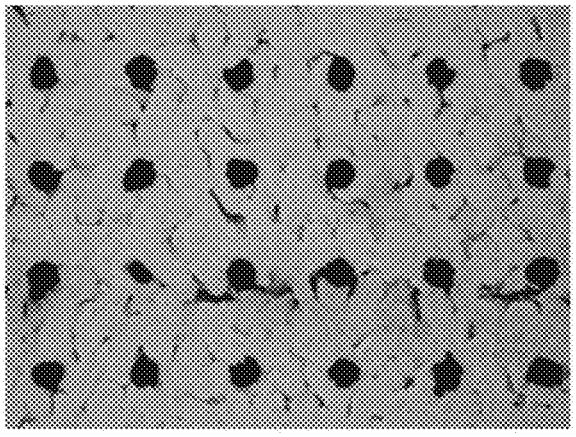
Figure 6C:
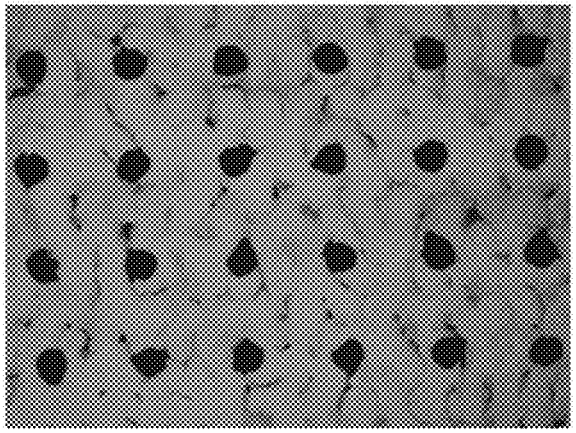

In the ink jet recording apparatus 100 illustrated in FIG. 1, a reaction liquid is applied onto the transfer body 101 by applying a reaction liquid to the transfer body 101 with the reaction liquid application device 103. Then, a test pattern was printed on the applied reaction liquid with the ink application unit 104*a* and the ink application unit 104*b*. In this example, in the test pattern, a 20 g/m$^2$ solid image was drawn with the cyan ink using the ink application device 104*a*, and then single dots of the black ink were drawn at equal intervals on the solid image with the ink application device 104*b* located on the downstream side relative to the ink application device 104*a*. In this example, the time until the black ink was applied with the ink application device 104*b* after the cyan ink was applied with the ink application device 104*a* was 200 msec. The temperature of the transfer body 101 was set to 60° C. Subsequently, a test pattern printed with the line type sensor 1*a* was imaged. FIG. 6A is an imaging result of the test pattern printed using the ink application unit 104*a* and the ink application unit 104*b* after applying 0.35 g/m$^2$ of a reaction liquid with the reaction liquid application device 103. Herein, 0.35 g/m$^2$, which is the application amount of the reaction liquid, is the weight measured by a gravimetric method after sufficiently drying water. Similarly, FIG. 6B illustrates an imaging result of a test pattern when the reaction liquid application amount is 0.50 g/m$^2$ and FIG. 6C illustrates an imaging result of a test pattern when the reaction liquid application amount is 0.65 g/m$^2$. When three imaging results of FIGS. 6A, 6B, and 6C were compared, the ten-point average values of the single dot diameters of the black ink applied with the ink application device 104*b* were 33 μm, 39 μm, and 39 μm in the images of FIG. 6A, FIG. 6B, and FIG. 6C, respectively. When the pattern of FIG. 6A is observed under a microscope, a state where the dots of the cyan ink spread and contact each other to form a flat film around the black dots can be observed. On the other hand, in FIG. 6B and FIG. 6C, each dot of the cyan ink spreads and the flatness of the film is not as high as that of the pattern of FIG. 6A, and thus a state where solid contents are sufficiently aggregated can be observed. It was able to be confirmed from the test patterns of Examples that, when the number of times of repeatedly using the liquid absorbing member 105*a* is large, it is suitable to apply 0.50 g/m$^2$ or more of a reaction liquid for preventing the solid content from moving to the liquid absorbing member 105*a*.

The example embodiments of the present disclosure can correctly detect the degree of the aggregation reaction by a reaction liquid.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-131065 filed Jul. 4, 2017, which is hereby incorporated by reference herein in its entirety.

What is claimed is:

1. A printing apparatus comprising:

an ink application unit applying a first ink containing at least a resin as a solid content onto a discharge medium;

a reaction liquid application unit applying a reaction liquid reacting with a component in the ink to aggregate the solid content in the first ink onto the discharge medium; and a liquid absorbing unit for bringing a liquid absorbing member of a porous body into contact with an ink image formed by the ink and the reaction liquid on the discharge medium to absorb liquid to thereby reduce an amount of the liquid in the ink image, wherein the printing apparatus has a receiving unit receiving an instruction for detecting a degree of the reaction of the ink and the reaction liquid on the discharge medium and a control unit controls the ink application unit and the reaction liquid application unit in response to reception of the instruction by the receiving unit to form a layer on the discharge medium with the first ink and the reaction liquid and causes the ink application unit to apply a second ink different from the first ink to a part of the layer to print a test pattern utilized for the detection.

2. The printing apparatus according to claim 1, wherein the first ink and the second ink are different in color.

3. The printing apparatus according to claim 1, wherein the first ink does not contain a coloring material and the second ink contains a coloring material.

4. The printing apparatus according to claim 1, wherein a brightness of the first ink is higher than a brightness of the second ink.

5. The printing apparatus according to claim 1, wherein the second ink is scattered at a plurality of places on the layer in the test pattern.

6. The printing apparatus according to claim 1, further comprising:

a moving unit causing the discharge medium and the liquid absorbing member to move relative to each other, wherein when the test pattern is printed, the moving unit separates the discharge medium and the liquid absorbing member from each other.

7. The printing apparatus according to claim 6, further comprising:

a unit heating and drying the printed test pattern.

8. The printing apparatus according to claim 1, wherein the control unit controls the ink application unit to perform an operation for changing an application amount of the reaction liquid to the discharge medium according to an input relating to the printed test pattern.

9. The printing apparatus according to claim 1, further comprising:

a reading unit reading the printed test pattern; and a unit notifying information on the printed test pattern to a user.

10. The printing apparatus according to claim 1, wherein the reaction liquid application unit applies the reaction liquid to the discharge medium by a roller to thereby apply the reaction liquid to the discharge medium.

11. The printing apparatus according to claim 1, wherein the discharge medium is a transfer body for holding an ink image to be transferred to a recording medium for recording an image.

12. A printing apparatus comprising:

an ink application unit applying a first ink containing at least a resin as a solid content onto a transfer body;

a reaction liquid application unit applying a reaction liquid reacting with a component in the ink to aggregate the solid content in the first ink onto a discharge medium;

a liquid absorbing unit for bringing a liquid absorbing member of a porous body into contact with an ink image formed by the ink and the reaction liquid on the discharge medium to absorb liquid to thereby concentrate the ink in the ink image; and a transfer unit transferring the ink image after subjected to the liquid absorption by the liquid absorbing unit to a recording medium, wherein the printing apparatus has a receiving unit receiving an instruction for detecting a degree of the reaction of the ink and the reaction liquid on the discharge medium and a control unit controls the ink application unit and the reaction liquid application unit in response to reception of the instruction by the receiving unit to form a layer on the discharge medium with the first ink and the reaction liquid and causes the ink application unit to apply a second ink different from the first ink to a part of the layer to print a test pattern utilized for the detection.

13. A printing method comprising:

applying a first ink containing at least a resin as a solid content onto a discharge medium;

applying a reaction liquid reacting with a component in the ink to aggregate the solid content in the first ink onto the discharge medium; and bringing a liquid absorbing member of a porous body into contact with an ink image formed by the ink and the reaction liquid on the discharge medium to absorb liquid to thereby reduce an amount of the liquid in the ink image, wherein a layer is formed with the first ink and the reaction liquid on the discharge medium according to an instruction for detecting a degree of a reaction of the ink and the reaction liquid on the discharge medium, and then a test pattern utilized for the detection is printed by applying a second ink different from the first ink to a part of the layer by the ink application unit.

14. The printing method according to claim 13, further comprising:

changing an application amount of the reaction liquid to the discharge medium according to the printed pattern.

* * * * *